US006244080B1

(12) United States Patent
Sakurai

(10) Patent No.: US 6,244,080 B1
(45) Date of Patent: Jun. 12, 2001

(54) ANTITHEFT LOCK ASSEMBLY

(75) Inventor: Masanori Sakurai, Tokyo (JP)

(73) Assignee: Sugatsune Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/080,407

(22) Filed: May 18, 1998

(30) Foreign Application Priority Data

May 16, 1997 (JP) ..... 9-143061

(51) Int. Cl.[7] ..... E05B 73/00
(52) U.S. Cl. ..... 70/14; 70/58
(58) Field of Search ..... 70/14, 18, 58, 70/49, 57, 430; 248/553, 551

(56) References Cited

U.S. PATENT DOCUMENTS

| | | | | |
|---|---|---|---|---|
| 468,630 | * | 2/1892 | Travis | 70/430 |
| 800,648 | * | 10/1905 | Higinbotham | 70/14 |
| 1,322,728 | * | 11/1919 | Read | 70/18 |
| 1,463,387 | * | 7/1923 | Chapman | 70/18 |
| 1,520,806 | * | 12/1924 | Canelles | 70/430 |
| 1,904,225 | * | 4/1933 | Hendrix | 70/430 |
| 2,172,208 | * | 9/1939 | Kurtzon | 70/14 |
| 2,578,547 | * | 12/1951 | Hilger | 70/14 X |
| 2,677,261 | * | 5/1954 | Jacobi | 70/428 |
| 2,742,726 | * | 4/1956 | Feller | 70/14 |
| 3,422,560 | * | 1/1969 | Foote et al. | 70/58 X |
| 3,855,825 | * | 12/1974 | Pickard | 70/14 |
| 4,296,615 | * | 10/1981 | Zoor | 70/58 X |
| 4,964,284 | * | 10/1990 | McDaid | 70/57 X |
| 5,063,763 | * | 11/1991 | Johnson | 70/58 |
| 5,344,329 | * | 9/1994 | Faller | 70/57 X |
| 5,502,989 | * | 4/1996 | Murray, Jr. et al. | 248/551 X |
| 5,913,907 | * | 6/1999 | Lee | 70/14 X |
| 6,000,251 | * | 12/1999 | Murray, Jr. et al. | 70/18 X |
| 6,006,557 | * | 12/1999 | Carl et al. | 70/14 X |
| 6,088,229 | * | 7/2000 | Seto et al. | 70/58 X |

FOREIGN PATENT DOCUMENTS

| | | | | |
|---|---|---|---|---|
| 2800980 | * | 7/1978 | (DE) | 70/18 |
| 1557208 | * | 12/1979 | (GB) | 70/18 |

* cited by examiner

*Primary Examiner*—Lloyd A. Gall
(74) *Attorney, Agent, or Firm*—Jacobson, Price, Holman & Stern, PLLC

(57) ABSTRACT

With an antitheft lock assembly, the extreme anchor section projecting from the lock main body of the lock assembly is inserted into the corresponding engaging slot of an object to be protected against theft and the cylinder lock of the lock assembly is operated by a matching key to protect the object against theft when the wire rope extending from the lock main body is wound around an immovable pillar. The lock main body may not be obstructed for its operation by the desk top if the object is placed on it and the engaging slot located at a lower position of the object. In the unlocked state, the rotary hook shaft and the single anti-revolution arm axially and eccentrically extending from the lock main body 1 are introduced into the vertically arranged engaging slot H of the object B to be protected against theft. As the cylinder lock 1A of the lock main body 1 is rotated by the key, the extreme anchor section 10*b* projecting from the axial core rod 10*a* of the rotary hook shaft 10 toward the anti-revolution arm 11 is turned by 90 degrees to make the lock main body unremovable from the object B through the engaging slot H to put the lock assembly into the locked state. With this arrangement, the distance g between the eccentrically located anti-revolution arm 11 and the outer periphery of the lock main body 1 can be reduced to avoid a situation where the lock main body 1 abuts the desk top and becomes inoperable.

3 Claims, 5 Drawing Sheets

ANTITHEFT LOCK ASSEMBLY

BACKGROUND OF THE INVENTION

1. Field of the Invention

This invention relates to an improvement to an antitheft lock assembly to be used with an object to be protected against theft, which may be a personal computer or some other expensive commodity having an engaging slot cut through the wall of the housing thereof, of the type having a lock main body including a cylinder that comprises a rotary hook shaft such that, as the rotary hook shaft is inserted into the engaging slot and the cylinder lock is operated with a matching key, the extreme anchor section of the rotary hook shaft is made unremovable from the object through the engaging slot to prevent the object from being wrongfully taken away if the wire rope extending from the lock main body is wound around a pillar or some other immovable object on the site.

2. Prior Art

Various lock assemblies of the type under consideration have been proposed, including those that are currently commercially available (as the one disclosed in U.S. Pat. No. 5,327,752). They typically comprise a lock main body 1 and a binding wire rope 2 extending from it as shown in FIG. 7 of the accompanying drawings. The stranded wire 2*a* of the wire rope 2 has a loop 2*c* at the front end thereof with a fixture 2*b* fitted to the root of the loop 2*c*. The lock main body 1 may or may not be made to pass through the loop 2*c* before the binding wire rope 2 is secured to an immovable object such as a pillar of the building by means of the loop 2*c*, while the lock main body 1 is unremovably inserted into and secured to an engaging slot H arranged in the object B to be protected against theft, which may be an expensive commodity for sale such as a portable computer, once it is locked as will be described hereinafter.

Referring to FIG. 7, the lock main body 1 comprises a cylinder lock 1A of a known type constituted by a cylindrical outer shell 1*a*, a cylindrical inner shell 1*b* and a pin tumbler 1*c* (not shown) and an aligning cap 3 covering a rear portion of the cylindrical outer shell 1*a* from behind in such a way that it is axially and outwardly slidable relative to the cylindrical outer shell 1*a* by distance S. Additionally, as shown, a rotary hook shaft 1*d* axially extends from the rear end of the cylindrical inner shell 1*b* as integral part thereof.

The rotary hook shaft 1*d* includes an axial core rod 1*f* aligned with the lock main body 1 and extending rearwardly through the rear center hole 3*a* of the aligning cap 3, said rotary hook shaft 1*d* being adapted to rotate by a predetermined angle of limitation, e.g., 90 degrees, as the matching key is operated in the keyhole 1*e* of the cylindrical inner shell 1*b*, and an extreme anchor section 1*g* extending perpendicularly relative to the axial core rod 1*f*.

A pair of anti-revolution arms 4*a*, 4*b* are arranged oppositely with the axial core rod 1*d* interposed therebetween and extend from the rear center hole 3*a* of the aligning cap 3 to just in front of the extreme anchor section 1*g*, the distance between the outer peripheral edges of the paired anti-revolution arms 4*a*, 4*b* being substantially equal to the lateral length L of the extreme anchor section 1*g*. Additionally, a pair of radially extending plate sections 4*c* are arranged within the aligning cap 3 and extend radially from and perpendicularly relative to the respective anti-revolution arms 4*a*, 4*b* to abut a rear end control projection 1*i* projecting from the rear wall surface 1*h* of the cylindrical outer shell 1*a* to confine the revolution of the rotary hook shaft 1*d* to a predetermined extent. The anti-revolution arms 4*a*, 4*b* and the radially extending plate sections 4*c* constitute an anti-revolution mechanism 4. A spring is disposed between the radially extending plate sections 4*c* and the inner wall surface 3*b* of the rear wall of the aligning cap 3.

In the arrangement of FIG. 7, an angle limiting cam 6 is arranged at and engaged with the rear end of the cylindrical inner shell 1*b* to rotate together by the predetermined control angle as the key is operated. More specifically, the angle of rotation of the cylindrical inner shell 1*b* is limited by a pair of stopper projections (not shown) arranged on the angle limiting cam 6 as one of the stopper projections abuts the rear end control projection 1*i* at a time.

The rear surface 6*a* of the angle limiting cam 6 is held in contact with the front surfaces of the radially extending plate sections 4*c* under pressure as the latter are urged by the spring 5. At the same time, the aligning cap 3 is also urged by the spring 5 to project rearward by a predetermined length S until the leftmost edge of slide slot 3*c* of the aligning cap 3 abuts stopper 1*j* projecting radially from the cylindrical outer shell 1*a*.

With an antitheft lock assembly having configuration as described above, the lock main body 1 is made to pass through the loop 2*c* and the stranded wire 2*a* of the wire rope 2 is wound around a pillar. Then, after ensuring that the paired anti-revolution arms 4*a*, 4*b* of the anti-revolution mechanism 4 and the extreme anchor section 1*g* of the rotary hook shaft 1*d* are aligned to indicate an unlocked condition of the assembly, they are pushed into the engaging slot H of the object B and the front ends of the anti-revolution arms 4*a*, 4*b* are engagedly held in place in the engaging slot H to prevent the lock main body 1 from being unintentionally rotated. Under this condition, the extreme anchor section 1*g* of the rotary hook shaft 1*d* should have passed and projecting from the engaging slot H.

Note that the antitheft lock assembly is adapted to accommodate variations in the thickness d of the outer frame of the object B to be protected against theft because the aligning cap 3 is axially movable against the resilient force of the spring 5. Thus, as the key (not shown) is operated to rotate the cylindrical inner shell 1*b* by the angle of limitation (90 degrees in the illustrated example), the extreme anchor section 1*g* is also turned to become perpendicular relative to the anti-revolution arms 4*a*, 4*b* and puts the assembly into a locked condition. Then, the lock main body 1*b* cannot be pulled out of the object B, which may be a portable computer or some other expensive commodity, so that it is securely held against theft. Note that, in FIG. 7, reference numeral 7 denotes a flange for preventing the cylindrical inner shell 1*b* from slipping out of the cylindrical outer shell 1*a* as it abuts the rear wall surface 1*h* of the cylindrical outer shell 1*a*.

In FIG. 7, the base section of the wire rope 2 is firmly secured in a coupling hole 2*g* running perpendicularly relative to the axis of the lock main body 1 in a rotary coupling section 2*f* projecting from an annular ring 2*e* that is rotatably arranged near the front end of the lock main body 1.

More specifically, a coupling sleeve 2*h* is fitted to the base end 2*d* of the wire rope 2 and provided at the end thereof with an anti-escape hook 2*i* that becomes engaged with an anti-escape notch 2*j* formed on the annular ring 2*e* as the coupling sleeve 2*h* is inserted into the coupling hole 2*g*.

FIGS. 8A and 8B show another known antitheft lock assembly obtained by modifying the assembly of FIG. 7 such that, while the paired anti-revolution arms 4*a*, 4*b* extend from the aligning cap 3 through the rear center hole 3*a* thereof in FIG. 7, the anti-revolution arms of this assembly project from the rear wall of the aligning cap 3.

Thus, as the key is operated in the cylinder lock 1A, the rotary hook shaft 1*d* including the axial core rod 1*f* and the extreme anchor section 1*g* located at the remote end of the axial core rod 1*f* to show a T-shaped lateral view rotates by 90 degrees from the state shown in FIG. 8A to get into a locked condition as shown in FIG. 8B, where the extreme anchor section 1*g* is perpendicular relative to the engaging slot H to make it impossible to pull out the lock main body 1 from the object B to be protected against theft.

Currently, various commodities provided with an antitheft arrangement are commercially available. FIGS. 9A and 9B show two typical engaging slots H that can be found in such commodities. In FIG. 9A, the object B to be protected against theft is provided on a wall B1 thereof with a recess B2 for receiving the aligning cap 3 and an engaging slot H is arranged in the recess B2. In FIG. 9B, the object B is provided only with an engaging slot H and the lower end of the slot H is located very close to the bottom surface B3 of the object B.

Anyway, with any known antitheft lock assembly having a configuration as described above, as the anti-revolution arms 4*a*, 4*b* projecting from the lock main body 1 are introduced into the antitheft engaging slot H and axial core rod 1*f* arranged between the anti-revolution arm 4*a*, 4*b* is rotated by a predetermined angle by operating the key, the extreme anchor section 1*g* extending from the axial core rod if to show a T-shaped lateral view is moved from the state aligned with the engaging slot H to an engaged state to make it impossible for the lock assembly to come out from the object B to be protected against theft.

However, the use of a pair of anti-revolution arms 4*a*, 4*b* projecting from the lock main body 1 and a T-shaped rotary hook shaft 1*d* makes the configuration of the antitheft lock assembly rather complicated and costly. Additionally, while the arrangement of a recess and an engaging slot H as shown in FIG. 9A may operate well, a vertically arranged engaging slot H shown in FIG. 9B is accompanied by a drawback that the lower end H1 of the engaging slot H is often located very close to the bottom surface B3 of the object B and therefore, if the lock main body 1 is large relative to the distance h separating the lower end H1 of the engaging slot H and the bottom surface B3 of the object B, which is often very small and placed on top of a desk, the lock main body 1 can be obstructed by the desk top for its operation to make it impossible to properly put the antitheft lock assembly into a locked condition.

In view of the above identified problems of known antitheft lock assemblies, it is therefore the object of the present invention to provide an improved antitheft lock assembly that is free from the above problems. According to a first aspect of the invention, the above object can be achieved by providing an antitheft lock assembly of the type under consideration characterized in that only a single anti-revolution arm is extending from the lock main body and, in the locked state, the rotary hook shaft and the single anti-revolution arm are unrotatably inserted into the corresponding engaging slot of an object to be protected against theft to respectively abut the opposite ends of the slot so that they may not be rickety in the slot and the extreme anchor section is directed toward a lateral side of the anti-revolution arm so as to become retractable through the slot whereas, in the locked state, the extreme anchor section is directed toward a different direction so as to become unremovable through the slot.

Note that the axial core rod and the rotary hook shaft do not show a T-shaped lateral view and the former extends from the front end of the latter only in a direction to provide an L-shaped lateral view.

Thus, with the above arrangement, the components are reduced both in number and dimensions to consequently reduce the cost. Additionally, if the engaging slot is arranged vertically with the lower end located close to the bottom surface of the object to be protected against theft as described above by referring to FIG. 9B, the single anti-revolution arm projects rearwardly below the axial core rod and rests on the lower end of the engaging slot and hence the outer periphery of the lock main body is extended downward only by a limited length from the single anti-revolution arm if compared with any of the above described known antitheft lock assemblies. Thus, the lock main body will not be obstructed for its operation if the lower end of the engaging slot is located very close to the desk top where the object is placed.

According to a second aspect of the invention, in an antitheft lock assembly according to the first aspect, a simple straight rod is used for the anti-revolution arm to reduce the weight of the anti-revolution arm and, in the unlocked state, the extreme anchor section extending from the axial core rod of the rotary hook shaft is located vis-a-vis the inner lateral side of the anti-revolution arm near the free end thereof. With this arrangement, the anti-revolution arm and the extreme anchor section can be inserted into the corresponding engaging slot of an object to be protected against theft with ease and, since the anti-revolution arm is made relatively long, the antitheft lock assembly operates properly if the object to be protected against theft has a large wall thickness.

According to a third aspect of the invention, in an antitheft lock assembly according to the first aspect, the anti-revolution arm includes a base section and a projection projecting from the outer lateral side of the base section to increase the mechanical strength of the anti-revolution arm. According to a fourth aspect of the invention, in an antitheft lock assembly according to the first aspect, the anti-revolution arm includes only a base section to reduce the weight of the lock assembly and make the operation of inserting the rotary hook shaft into the engaging slot easier.

According to a fifth aspect of the invention, there is provided an antitheft lock assembly of the type under consideration characterized in that only a single anti-revolution arm is extending from the lock main body as in the case of an antitheft lock assembly according to any of the first through fourth aspects but, unlike the latter, the rotary hook shaft and the single anti-revolution arm are inserted into the corresponding engaging slot of an object to be protected against theft with a gap found at one or both of the opposite ends of the engaging slot and the anti-revolution arm is located relatively close to the axial core rod of the rotary hook shaft. This arrangement provides the advantage of low cost as in the case of a lock assembly according to the first aspect and, additionally, the rotary hook shaft and the anti-revolution arm can be inserted into the engaging slot with ease. Additionally, the lock main body can be moved upward within the slot by making use of the gap or gaps to avoid the above described problem of obstructing the operation of the lock main body if the engaging slot is arranged vertically and located close to the bottom surface of the object to be protected against theft.

According to a sixth aspect of the invention, in an antitheft lock assembly according to the fifth aspect, a simple straight rod is used for the anti-revolution arm and the extreme anchor section projecting from a lateral side of the axial core rod of the rotary hook shaft is located close to the front end of the anti-revolution arm so that the anti-revolution arm and the rotary hook shaft can be inserted into the corresponding engaging slot of an object to be protected against theft. According to a seventh aspect of the invention, in an antitheft lock assembly according to the fifth aspect, a relatively long and simple rod is used for the anti-revolution arm and the extreme anchor section laterally extending from the axial core rod of the rotary hook shaft is projecting in a direction opposite to the anti-revolution arm projecting from the engaging slot. This arrangement can accommodate an object to be protected against theft if the latter has a relatively thick wall.

SUMMARY OF THE INVENTION

Therefore, it is the object of the present invention to provide an improved antitheft lock assembly.

According to the first aspect of the invention, the above object is achieved by providing an antitheft lock assembly comprising a lock main body, a binding wire rope extending from the lock main body to become wound around an immovable object, the lock main body having a rotary hook shaft extending from it and including an axial core rod and an extreme anchor section extending laterally from the axial core rod and an anti-revolution arm also extending from the lock main body in parallel with the axial core rod, the rotary hook shaft and the anti-revolution being adapted to be inserted together into a corresponding engaging slot of an object to be protected against theft, the rotary hook shaft being adapted to be rotated by a predetermined angle by operating a matching key in the cylinder lock of the lock main body to make the extreme anchor section unremovable from the object through the engaging slot, characterized in that, in the unlocked state, both the axial core rod of the rotary hook shaft and the single anti-revolution arm are unrotatably inserted into the engaging slot of the object to be protected against theft to respectively abut the opposite ends of the slot and the extreme anchor section is directed toward the oppositely disposed lateral side of the anti-revolution arm whereas, in the locked state, the extreme anchor section is directed toward a different direction so as to become unremovable through the slot.

According to the second aspect of the invention, in an antitheft lock assembly according to the first aspect in the unlocked state where both the rotary hook shaft and the anti-revolution arm are inserted into the corresponding engaging slot, the extreme anchor section extending laterally from the axial core rod of the rotary hook shaft is located vis-a-vis the inner lateral side of the anti-revolution arm near the free end thereof, said anti-revolution arm being made of a simple straight rod. According to the third aspect of the invention, in an antitheft lock assembly according to the first aspect in the unlocked state where both the rotary hook shaft and the anti-revolution arm are inserted into the corresponding engaging slot, the extreme anchor section extending laterally from the axial core rod of the rotary hook shaft is located vis-a-vis the inner lateral side of the projection of the anti-revolution arm near the free end thereof, said anti-revolution arm including a base section and the projection projecting from the outer lateral side of the base section. According to the fourth aspect of the invention, in an antitheft lock assembly according to the first aspect in the unlocked state where both the rotary hook shaft and the anti-revolution arm are inserted into the corresponding engaging slot, the extreme anchor section extending laterally from the axial core rod of the rotary hook shaft is located vis-a-vis the outer surface of the base section of the anti-revolution arm, said base section being located within the engaging slot.

According to the fifth aspect of the invention, the above object is achieved by providing an antitheft lock assembly comprising a lock main body, a binding wire rope extending from the lock main body to become wound around an immovable object, the lock main body having a rotary hook shaft extending from it and including an axial core rod and an extreme anchor section extending laterally from the axial core rod and an anti-revolution arm also extending from the lock main body in parallel with the axial core rod, the rotary hook shaft and the anti-revolution being adapted to be inserted together into a corresponding engaging slot of an object to be protected against theft, the rotary hook shaft being adapted to be rotated by a predetermined angle by operating a matching key in the cylinder lock of the lock main body to make the extreme anchor section unremovable from the object through the engaging slot, characterized in that, in the unlocked state, both the axial core rod of the rotary hook shaft and the single anti-revolution arm are unrotatably inserted into the engaging slot of the object to be protected against theft with a gap found at one or both of the opposite ends of the engaging slot and the extreme anchor section is directed toward one of the opposite ends of the engaging slot whereas, in the locked state, the extreme anchor section is directed toward a different direction so as to become unremovable through the slot.

According to the sixth aspect of the invention, in an antitheft lock assembly according to the fifth aspect in the unlocked state where both the rotary hook shaft and the anti-revolution arm are inserted into the corresponding engaging slot, the extreme anchor section extending laterally from the axial core rod of the rotary hook shaft is located vis-a-vis the end surface of the anti-revolution arm, said anti-revolution arm being made of a simple straight rod. According to the seventh aspect of the invention, in an antitheft lock assembly according to the fifth aspect in the unlocked state where both the rotary hook shaft and the anti-revolution arm are inserted into the corresponding engaging slot, the extreme anchor section extending laterally from the axial core rod of the rotary hook shaft is projecting in a direction opposite to the anti-revolution arm projecting from the engaging slot, said anti-revolution arm being made of a relatively long and simple rod.

BRIEF DESCRIPTION OF THE ACCOMPANYING DRAWINGS

Figure 3A:
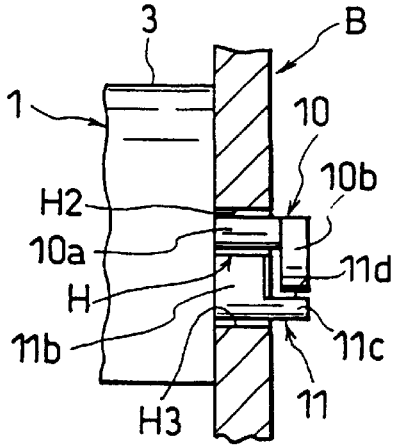
FIG. 3A is a schematic lateral cross sectional partial view of an antitheft lock assembly according to the third aspect of the invention, showing only a principal area thereof.
Figure 3B:
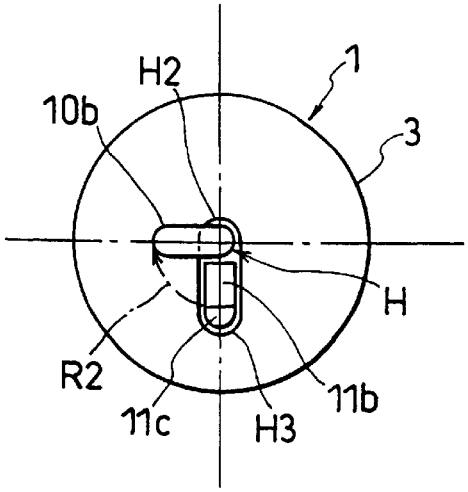

FIG. 3B schematic rear view of the lock main body of the antitheft lock assembly of FIG. 3A.

Figure 4A:
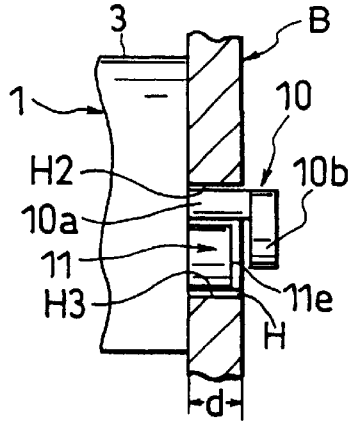

FIG. 4A is a schematic lateral cross sectional partial view of an antitheft lock assembly according to the fourth aspect of the invention, showing only a principal area thereof.

Figure 4B:
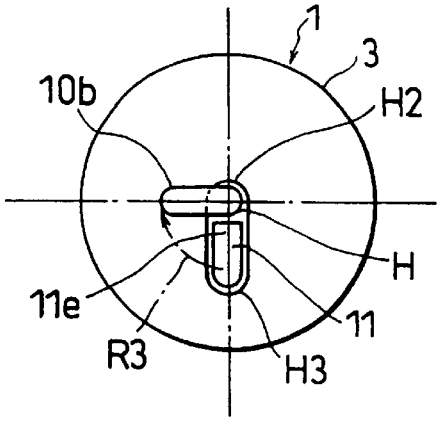

FIG. 4B is a schematic rear view of the lock main body of the antitheft lock assembly of FIG. 4A.

Figure 5A:
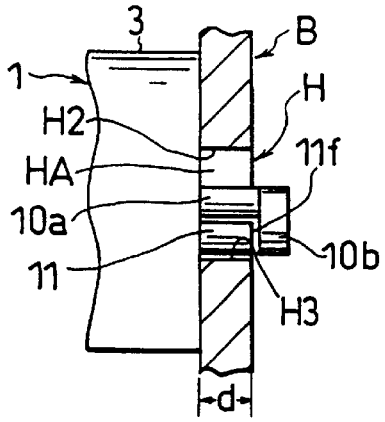

FIG. 5A is a schematic lateral cross sectional partial view of an antitheft lock assembly according to the fifth aspect of the invention, showing only a principal area thereof.

Figure 5B:
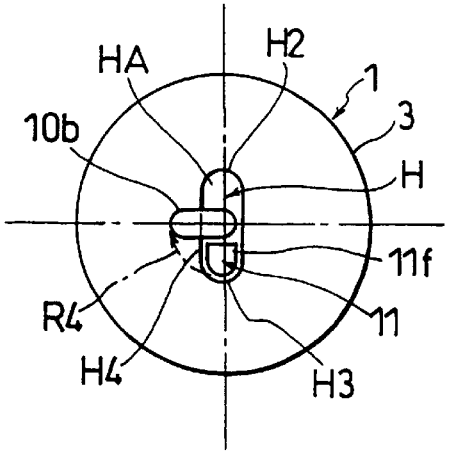

FIG. 5B is a schematic rear view of the lock main body of the antitheft lock assembly of FIG. 5A.

Figure 6A:
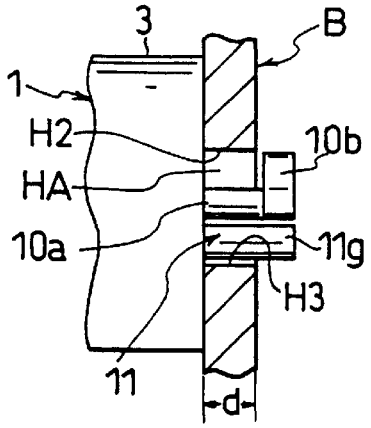

FIG. 6A is schematic lateral cross sectional partial view of an antitheft lock assembly according to the sixth aspect of the invention, showing only a principal area thereof.

Figure 6B:
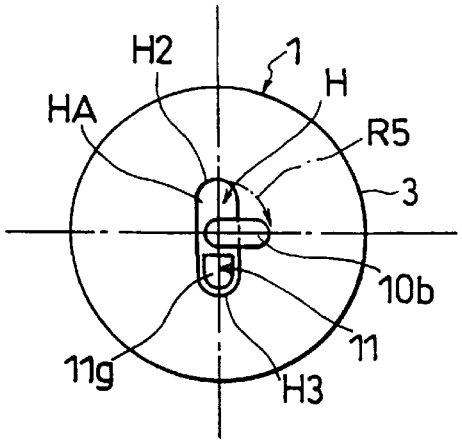

FIG. 6B is a schematic rear view of the lock main body of the antitheft lock assembly of FIG. 6A.

Figure 7:
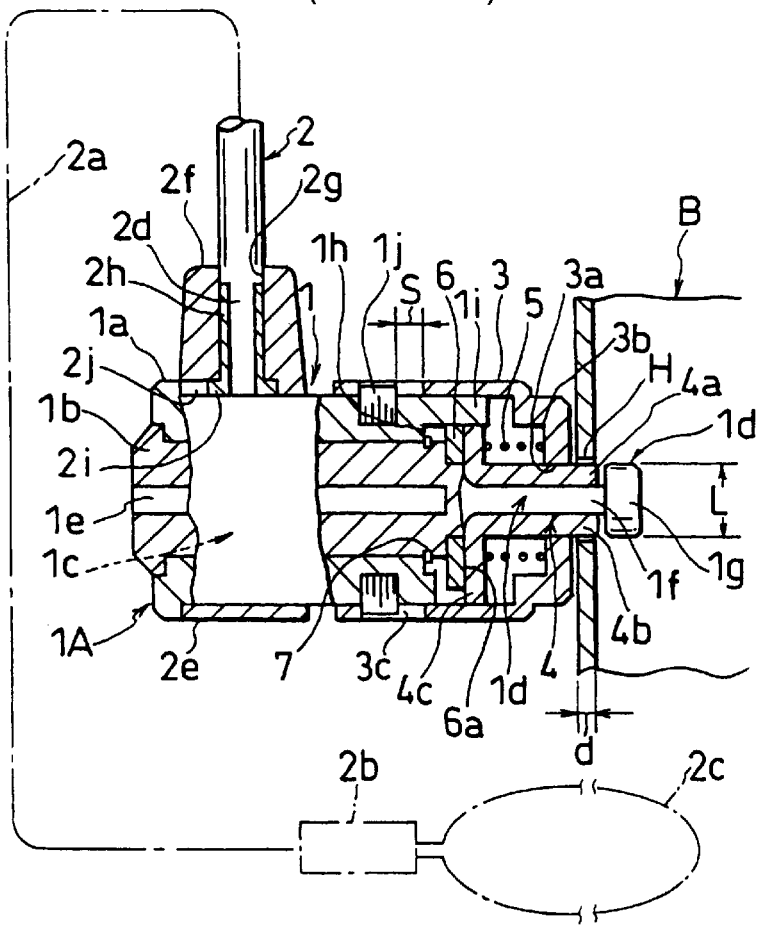
FIG.7 (PRIOR ART)

FIG. 7 is a schematic partially cut out lateral cross sectional view of a known antitheft lock assembly.

Figure 8A:
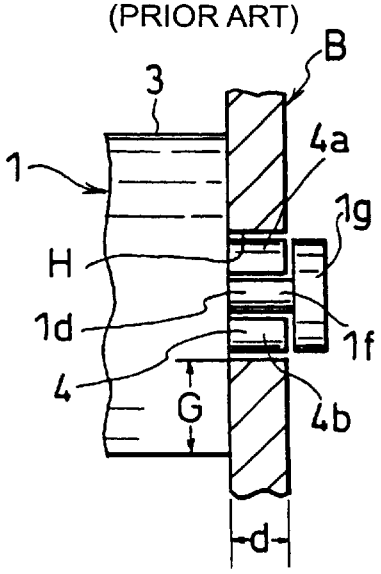
FIG.8(A) (PRIOR ART)

FIG. 8A is a schematic lateral cross sectional partial view of another known antitheft lock assembly, showing only a principal area thereof.

Figure 8B:
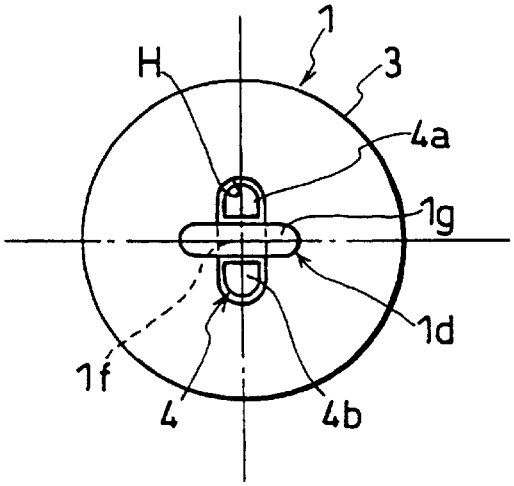
FIG.8(B) (PRIOR ART)

FIG. 8B is a schematic rear view of the lock main body of the antitheft lock assembly of FIG. 8A.

Figure 9A:
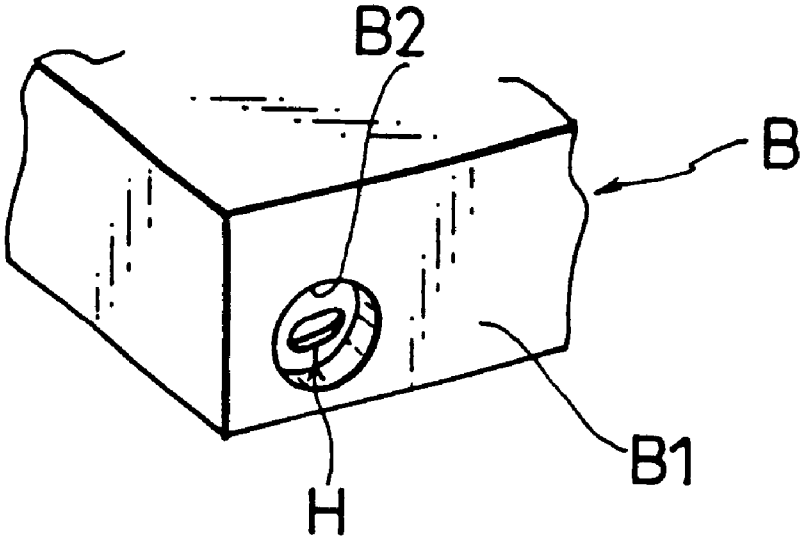
FIG. 9(A) (PRIOR ART)

FIG. 9A schematic perspective partial view of an object to be protected against theft having an engaging slot.

Figure 9B:
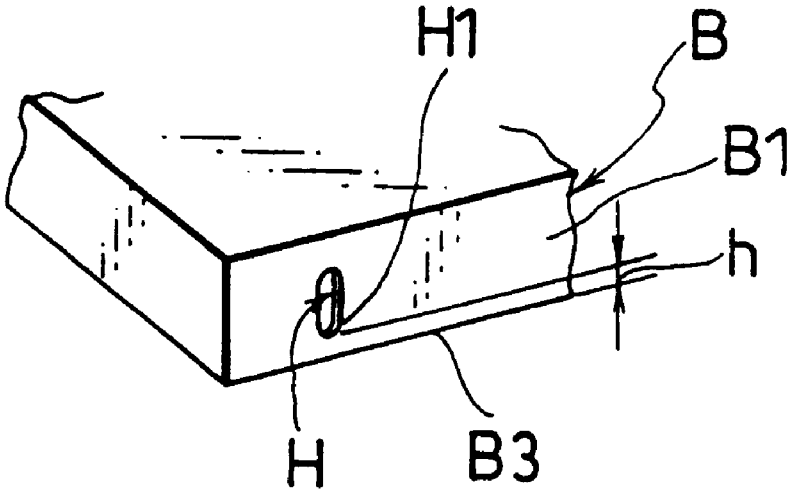
FIG. 9(B) (PRIOR ART)

FIG. 9B, schematic perspective partial view of another object to be protected against theft having an engaging slot different from that of FIG. 9A.

DETAILED DESCRIPTION OF THE INVENTION

Now, the present invention will be described in greater detail by referring to FIG. 1 through FIG. 6B of the accompanying drawing that illustrate preferred embodiments of the invention. Note that, throughout these embodiments, the components are substantially same as their counterparts of the antitheft lock assembly in FIG. 7 and hence denoted respectively by the same reference symbols.

Thus, with any of the embodiments, the wire rope 2 extending from the lock main body 1 is wound around a pillar or some other immovable object and the rotary hook shaft 10 and the anti-revolution arm 11 projecting in parallel from the lock main body 1 are inserted into the engaging slot H cut through the wall of the housing of the object B to be protected against theft so that, once the cylinder lock 1A of the lock main body 1 is operated with a matching key to rotate the rotary hook shaft 10 by a predetermined angle (c.f., 90 degrees), the extreme anchor section 10*b* laterally extending from the axial core rod 10*a* of the rotary hook shaft 10 becomes unremovable from the object through the engaging slot H.

Figure 1A:
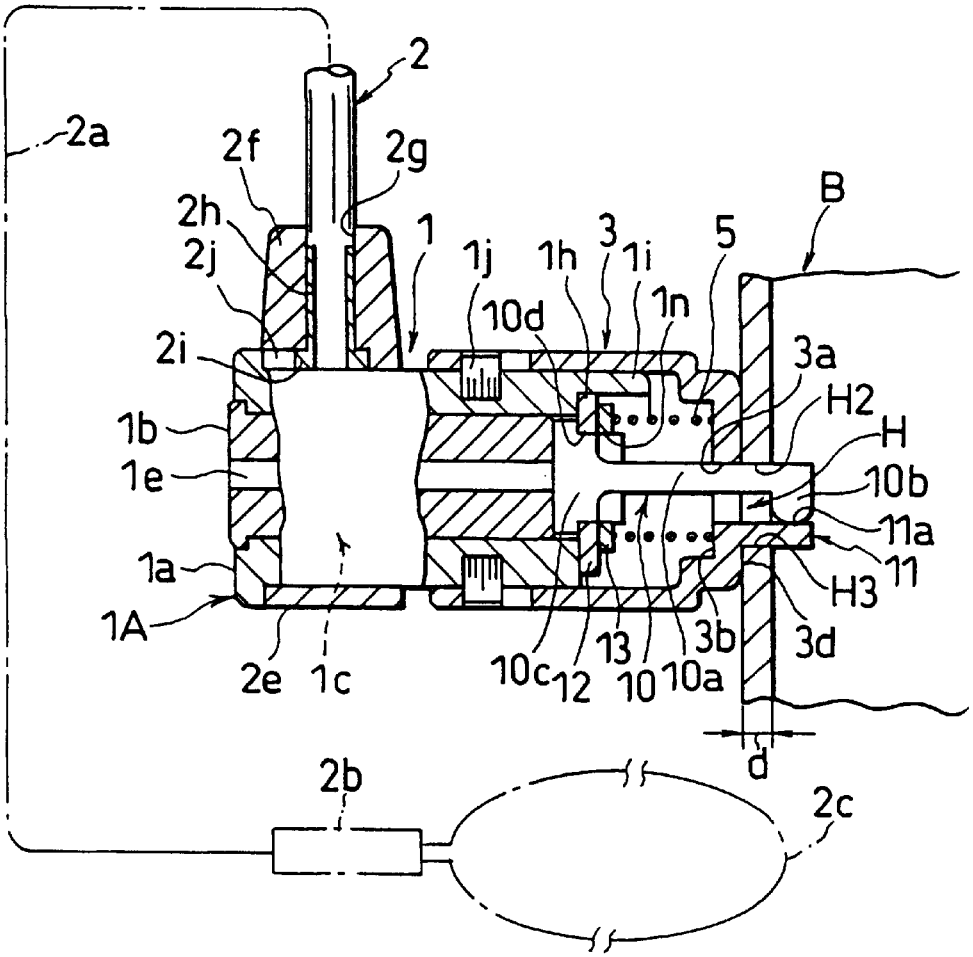
FIG. 1A is a schematic partially cut out lateral cross sectional view of an antitheft lock assembly according to the first aspect of the invention.
Figure 1B:
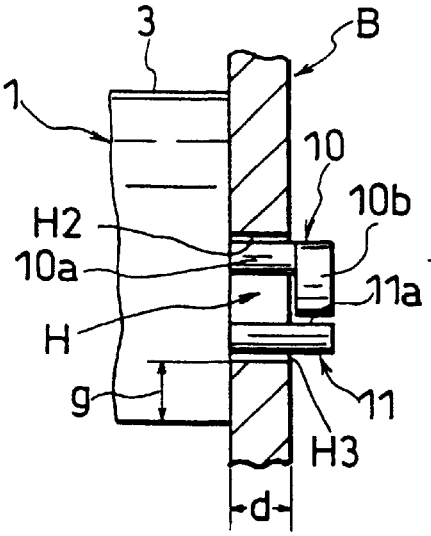
FIG. 1B is a schematic lateral cross sectional partial view of the lock main body of an antitheft lock assembly according to the second aspect of the invention, showing only a principal area thereof.
Figure 1C:
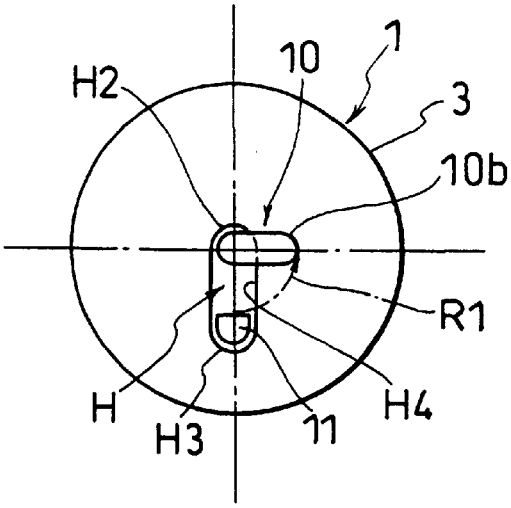
FIG. 1C is a schematic rear view of lock main body of the antitheft lock assembly of FIG. 1B.
Figure 2:
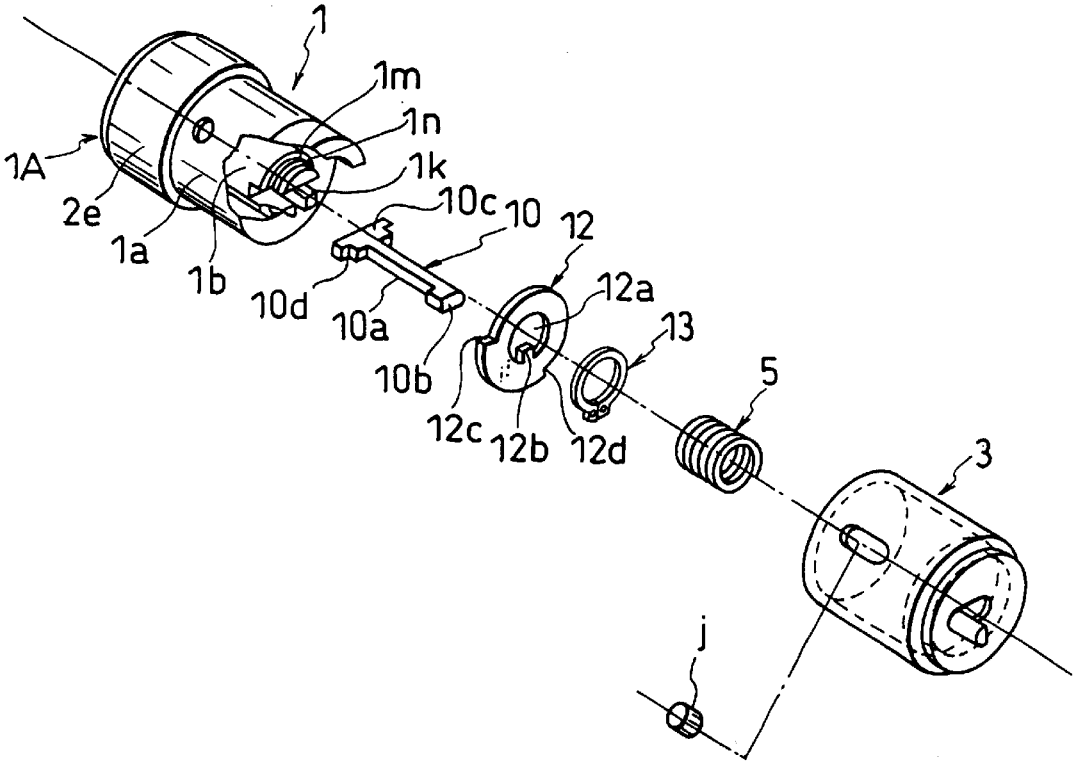
FIG. 2 is an exploded schematic perspective view of the lock main body of the antitheft lock assembly of FIG. 1A.

For the purpose of the invention, while the rotary hook shaft may be projecting rearwardly from the cylindrical inner shell 1*b* as an integral part thereof as shown in FIG. 7 and denoted by reference symbol 1*d* for a known lock assembly, desirably it is arranged as a component separable from the cylindrical inner shell 1*b* as shown in FIG. 1 and denoted by reference symbol 10 and comprises an axial core rod 10*a* having an engaging section 10*c* at the front end and an extreme anchor section 10*b* at the rear end to show a substantially I-shape as shown in FIG. 2. It is preferably made of a material such as stainless steel having a strength greater than the material of the cylindrical inner shell 1*b* to make it satisfactorily durable.

The engaging section 10*c* is received in a matching recess of a T-shaped engaging section 1*k* disposed at the rear end of the cylindrical inner shell 1*b* (see FIG. 2) so that the rotary hook shaft 10 rotates with the cylindrical inner shell 1*b*.

Additionally, engaging steps 10*d* are formed in the engaging section 10*c* and adapted to be pressed against the rear wall surface 1*h* of the cylindrical outer shell 1*a* while an annular angle control cam 12 is received by a stepped peripheral edge 1*m* of the cylindrical inner shell 1*b* (see FIG. 2). The angle control cam 12 has an axial hole 12*a* into which an engaging projection 12*b* is projecting. The engaging projection 12*b* is also adapted to be received in a matching recess of the T-shaped engaging section 1*k* so that the cam 12 also rotates with the cylindrical inner shell 1*b*.

The angle control cam 12 additionally has a pair of halt steps 12*c* and 12*d* (see FIG. 2) so that the cylindrical inner shell 1*b* may be rotated only by a predetermined control angle, e.g., 90 degrees, as in the case of the known lock assembly of FIG. 7 as the rear control projection 1*i* of the cylindrical outer shell 1*a* abuts either of the halt steps 12*c* and 12*d* at a time and is prevented from rotating further.

In the embodiment of FIG. 2, a C-shaped anti-release member 13 is pressed against the rear surface of the angle control cam 12 and received in an annular groove 1*n* in a rear end portion of the cylindrical inner shell 1*b* in order to prevent the angle control cam 12 from being released rearwardly.

While a pair of anti-revolution arms may be used for the purpose of the invention as in the case of a known lock assembly shown in FIG. 7, a single anti-revolution arm 11 is used in the embodiment of FIG. 1 and extends rearwardly not through the rear center hole 3*a* of the aligning cap 3 but directly from the rear wall surface 3*d* of the aligning cap 3. Thus, an antitheft lock assembly according to the invention differs from any known comparable ones in that a single anti-revolution arm 11 is used and the rotary hook shaft 10 arranged along the axis of the lock main body 1 has a unique configuration in addition to the above described unique positional relationship between the rotary hook shaft 10 and the anti-revolution arm 11.

More specifically, with a lock assembly according to the first aspect of the invention, in the unlocked state, the axial core rod 10*a* of the rotary hook shaft 10 and the single anti-revolution arm 11 are unrotatably inserted into the engaging slot H and made to abut the respective ends H2 and H3 of the slot.

Thus, the axial core rod 10*a* and the anti-revolution arm 11 are squarely received in the engaging slot H so that they may not become rickety in the slot H. Additionally, in the unlocked state, the extreme anchor section 10*b* of the rotary hook shaft 10 projects only toward the anti-revolution arm 11. In other words, while the rotary hook shaft 1*d* of a known lock assembly shows a T-shaped lateral view, the axial core rod 10*a* and the extreme anchor section 10*b* of the rotary hook shaft of a lock assembly according to the invention shows an L-shaped lateral view.

In the locked state, as the key is operated in the cylinder lock 1A, the extreme anchor section 10*b* that is projecting toward the anti-revolution arm 11 in the unlocked state is rotated and made to project laterally from a lateral edge H4 of the engaging slot H by a distance sufficient to make it unremovable through the slot H.

Note that, in the embodiment according to the second aspect of the invention as shown in FIGS. 1B and 1C, the rotary hook shaft 10 and the single anti-revolution arm 11 axially extending from the lock main body 1 are separated by a distance greater than those shown in FIG. 3 and FIG. 4, which will be described hereinafter, and the anti-revolution arm 11 is made of a relatively long straight rod. Thus, in the unlocked state, the extreme anchor section 10*b* of the rotary hook shaft 10 is located vis-a-vis and close to the inner lateral side 11*a* of the anti-revolution arm 11 near the free end thereof when the rotary hook shaft 10 and the anti-revolution arm 11 are inserted into the engaging slot H.

Referring to FIG. 1C, arrow R1 indicted by a phantom line shows the locus of the front end of the extreme anchor section 10*b* that is produced as it is rotated by 90 degrees from the unlocked state to the locked state.

Thus, a lock assembly according to the second aspect of the invention provides the advantage of low cost and, additionally, the ease with which the rotary hook shaft and the anti-revolution arm can be inserted into the engaging slot due to the fact that both the anti-revolution arm 11 and the extreme anchor section 10*b* extend rearwardly to a substantially same extent. Therefore, the anti-revolution arm 11 can be made to have a relatively large length with an enhanced level of mechanical strength so that it can accommodate an object B to be protected against theft if the latter has a relatively thick wall.

What is more important with the present invention is that, as easily seen from FIG. 1B, the engaging slot H is located eccentrically relative to the outer periphery of the lock main body 1 in a lock assembly according to any of the first through fourth aspects of the invention so that the distance g between the end H3 of the engaging slot H (that corresponds to the lower end H1 in FIG. 9B) and the corresponding extreme end of the outer periphery of the lock main body 1 can be significantly reduced from the corresponding distance G in FIG. 8 (by more than a half in the embodiment of FIG. 1B).

As a result, an object B to be protected against theft, which may be a portable computer, having a vertical engaging slot H as shown in FIG. 9B is free from the problem of the lock main body 1 obstructed by the desk top for its operation.

Now, an antitheft lock assembly according to the third aspect of the invention and illustrated in FIGS. 3A and 3B will be described. With this lock assembly, in the unlocked state where the rotary hook shaft 10 and the anti-revolution arm 11 are inserted into the engaging slot H, the extreme anchor section 10*b* extending laterally from the axial core rod 10*a* of the rotary hook shaft 10 is located vis-a-vis the inner lateral side 11*d* of the anti-revolution arm 11 near the free end thereof as the anti-revolution arm 11 includes a base section 11*b* and the projection 11*c* projecting from the outer lateral side of the base section 11*b*.

With this arrangement, the anti-revolution arm 11 comprises a base section 11*b* and a projection 11*c* to improve the mechanical strength of the anti-revolution arm 11 and the extreme anchor section 10*b* of the rotary hook shaft 10 can be made longer as compared to their counterparts of a lock assembly according to the second aspect so that the lock main body 1 of the lock assembly may be more resistive against the effort trying to pull it out from the object B to be protected against theft.

It will be appreciated that the distance g of this embodiment can also be significantly reduced from the distance G. Note that, in FIG. 3B, arrow R2 indicated by a phantom line shows the locus of the front end of the extreme anchor section 10*b* that is produced as it is rotated from the unlocked state to the locked state.

Now, an antitheft lock assembly according to the fourth aspect of the invention and illustrated in FIGS. 4A and 4B will be described. With this lock assembly, in the unlocked state where both the rotary hook shaft 10 and the anti-revolution arm 11 are inserted into the corresponding engaging slot H, the extreme anchor section 10*b* extending laterally from the axial core rod 10*a* of the rotary hook shaft 10 is located vis-a-vis the outer surface 11*e* of the base section 11*b* of the anti-revolution arm as the base section 11*b* is located within the engaging slot H.

Thus, with this arrangement, the projection 11*c* of the anti-revolution arm 11 of a lock assembly according to the third aspect is eliminated to reduce the weight of the lock assembly and the rotary hook shaft 10 and the anti-revolution arm 11 can be inserted into the engaging slot H more easily. Note that, in FIG. 4B, arrow R3 indicted by a phantom line shows the locus of the front end of the extreme anchor section 10*b* that is produced as it is rotated from the unlocked state to the locked state.

A lock assembly according to the fifth aspect of the invention differs from a lock assembly according to the first aspect in a manner as described below by referring to FIGS. 5A through 6B.

As seen from FIGS. 5A through 6B, in the unlocked state, the axial core rod 10*a* of the rotary hook shaft 10 and the anti-revolution arm 11 located relatively close to it are unrotatably inserted into the engaging slot H of an object B to be protected against theft with a gap HA found at one or both of the opposite ends of the engaging slot H so that both the rotary hook shaft 10 and the anti-revolution arm 11 may be moved longitudinally within the engaging slot H. Note that the extreme anchor section 10*b* is projecting along the engaging slot H under this condition.

In the locked state, to the contrary, the extreme anchor section 10*b* of the rotary hook shaft 10 is turned to a different direction to make the lock assembly unremovable from the object B as the extreme anchor section 10*b* is held by a lateral edge H4 of the engaging slot H.

Now, an antitheft lock assembly according to the sixth aspect of the invention and illustrated in FIGS. 5A and 5B will be described. With this lock assembly, in the unlocked state where the rotary hook shaft 10 and the anti-revolution arm 11 are loosely inserted into the engaging slot H, the extreme anchor section 10*b* extending laterally from the axial core rod 10*a* of the rotary hook shaft 10 is located vis-a-vis the end surface of the anti-revolution arm 11 which is made of a simple straight rod. Note that, in FIG. 5B, arrow R4 indicted by a phantom line shows the locus of the front end of the extreme anchor section 10*b* that is produced as it is rotated from the unlocked state to the locked state.

Thus, as seen from FIGS. 5A and 5B, when the end H3 of the engaging slot H is located low as the lower end H1 of FIG. 9B, the anti-revolution arm 11 will rest on the end H3 of the engaging slot H. However, the lock main body 1 can be moved upward along the slot until the axial core rod 10*a* abuts the upper opposite end H2 of the engaging slot H by applying an upward force to the lock main body 1. Therefore, the lock assembly can be operated properly if the engaging slot H is arranged vertically with a small value given to the distance h in FIG. 9B.

Additionally, with a lock assembly according to the sixth aspect of the invention as shown in FIGS. 5A and 5B, the extreme anchor section 10*b* is projecting laterally from the axial core rod 10*a* to the end surface 11*f* of the anti-revolution arm 11 that is made of a simple straight rod so that both the rotary hook shaft 10 and the anti-revolution arm 11 can be loosely inserted into the engaging slot H very easily.

Finally, an antitheft lock assembly according to the sixth aspect of the invention and illustrated in FIGS. 6A and 6B will be described. With this lock assembly, in the unlocked state where the rotary hook shaft 10 and the anti-revolution arm 11 are loosely inserted into the engaging slot H, the extreme anchor section 10*b* extending laterally from the axial core rod 10*a* of the rotary hook shaft 10 is projecting in a direction opposite to free end 11*g* of the anti-revolution arm 11 projecting from the engaging slot H and the anti-revolution arm 11 is made of a relatively long and simple rod.

With this arrangement, an engaging slot H as shown in FIG. 9B can be used without problem and, since the anti-revolution arm 11 is projecting by a large distance, the lock assembly can accommodate an object B to be protected against theft having a large wall thickness d. Additionally, the extreme anchor section 10*b* of the rotary hook shaft 10 is made to project in the opposite direction relative to its counterpart of a lock assembly according to the sixth aspect of the invention when the rotary hook shaft 10 and the anti-revolution arm 11 are inserted into the engaging slot H so that the lock assembly can be made reliably unremovable from the object B to be protected against theft through the engaging slot H.

Note that. in FIG. 6B, arrow R5 indicated by a phantom line shows the locus of the front end of the extreme anchor section 10*b* that is produced as it is rotated from the unlocked state to the locked state.

Thus, since an antitheft lock assembly according to the first aspect of the invention comprises a rotary hook shaft and a single anti-revolution arm axially and eccentrically extending from the lock main body that are tightly inserted into the corresponding engaging slot of an object to be protected against theft in the unlocked state, it is free from the problem that the lock main body is obstructed by the desk top for its operation when the engaging slot is located at a lower position of the object to be protected against theft, which may be a portable computer placed on a desk, and both the rotary hook shaft and the anti-revolution arm would not become rickety in the engaging slot.

Additionally, since the rotary hook shaft and the anti-revolution arm may be configured in a manner according to any of the second through fourth aspects of the invention, both the rotary hook shaft and the anti-revolution arm can be made lightweight and the lock assembly can be manufactured at reduced cost. Still additionally, the rotary hook shaft and the anti-revolution arm can be made to fit into an engaging slot as properly as ever to make the lock assembly highly reliable. On the other hand, since in an antitheft lock assembly according to the fifth aspect of the invention, the rotary hook shaft and the anti-revolution arm are made to be loosely inserted into the corresponding engaging slot of an object to be protected against theft, the lock assembly can be operated with ease. Additionally, since a gap is left at one or both of the ends of the engaging slot when the rotary hook shaft and the anti-revolution arm are inserted into the slot, the lock assembly is also free from the problem that the lock main body is obstructed by the desk top for its operation when the engaging slot is located at a lower position of the object to be protected against theft and hence can be operated highly reliably.

When a lock assembly is configured according to either the sixth or seventh aspect of the invention, the rotary hook shaft and the anti-revolution arm can also be loosely inserted into the corresponding engaging slot of an object to be protected against theft that may have a large wall thickness. Additionally, while the extreme anchor section projects only to a lateral side of the axial core rod 10*a,* it operates reliably for holding the lock assembly in a locked state.

What is claimed is:

1. In combination, an object having an engaging slot with two opposed ends and an antitheft lock assembly comprising a lock main body, a binding wire rope extending from the lock main body to become wound around an immovable object, the lock main body having a rotary hook shaft extending from it and said rotary hook shaft including an axial core rod and an extreme anchor section extending laterally from the axial core rod and a single anti-revolution arm also extending from the lock main body in parallel with the axial core rod, said axial core rod being outwardly laterally spaced from an exterior lateral surface of said anti-revolution arm, the rotary hook shaft and the anti-revolution arm being simultaneously insertable together into said engaging slot of said object to be protected against theft, said anti-revolution arm and said axial core rod being slidably mounted in said engaging slot along a longitudinal axis of said engaging slot, the rotary hook shaft being rotatable by a predetermined angle by operating a matching key in a cylinder lock of the lock main body to make the extreme anchor section nonremovable from the object through the engaging slot so that in the unlocked state, both the axial core rod of the rotary hook shaft and the single anti-revolution arm are simultaneously inserted in the engaging slot of the object to be protected against theft with a gap formed at one or both opposed ends of the engaging slot between the one or both opposed ends of the engaging slot and said anti-revolution arm and said axial core rod at least one gap being approximately one-third of the length of said engaging slot and the extreme anchor section is directed toward one of the opposed ends of the engaging slot whereas, in the locked state, the extreme anchor section is directed in a different direction so as to become nonremovable through the slot.

2. A combination according to claim 1, wherein, in the unlocked state where both the rotary hook shaft and the anti-revolution arm are inserted into the corresponding engaging slot, the extreme anchor section extending laterally from the axial core rod of the rotary hook shaft is located relative to an end surface of the anti-revolution arm, said anti-revolution arm being a straight rod.

3. A combination according to claim 1, wherein, in the unlocked state where both the rotary hook shaft and the anti-revolution arm are inserted into the corresponding engaging slot, the extreme anchor section extending laterally from the axial core rod of the rotary hook shaft is projecting in a direction opposite to the anti-revolution arm projecting from said engaging slot, said anti-revolution arm being a relatively long rod.

* * * * *